US006612568B1

(12) United States Patent
Gaissmaier et al.

(10) Patent No.: US 6,612,568 B1
(45) Date of Patent: Sep. 2, 2003

(54) PILING RACK FOR FLAT PARCELS

(75) Inventors: Herbert Gaissmaier, Rot a.d. Rot (DE); Stefan Neumann, Radolfzell (DE); Albrecht Sieper, Gelnhausen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/622,338

(22) PCT Filed: Jan. 19, 1999

(86) PCT No.: PCT/DE99/00117

§ 371 (c)(1),
(2), (4) Date: Jun. 4, 2001

(87) PCT Pub. No.: WO99/41021

PCT Pub. Date: Aug. 19, 1999

(30) Foreign Application Priority Data

Feb. 11, 1998 (DE) ..... 198 05 562

(51) Int. Cl.[7] ..... B65H 31/14

(52) U.S. Cl. ..... 271/219; 271/213; 271/214; 271/215; 271/217; 414/788.1

(58) Field of Search ..... 271/176, 207, 271/213, 214, 215, 217, 219, 220; 414/788.1, 788.9, 791.5

(56) References Cited

U.S. PATENT DOCUMENTS

| | | | | |
|---|---|---|---|---|
| 1,449,750 A | * | 3/1923 | Hampshire | 271/213 |
| 3,717,249 A | * | 2/1973 | Faley | 209/552 |
| 4,146,218 A | * | 3/1979 | Loftus et al. | 271/220 |
| 4,682,770 A | * | 7/1987 | Dempf et al. | 271/176 |
| 4,838,480 A | * | 6/1989 | Takahashi et al. | 232/43.3 |
| 4,838,539 A | | 6/1989 | Zimmermann | 271/305 |
| 5,263,300 A | | 11/1993 | Plent et al. | 53/244 |

FOREIGN PATENT DOCUMENTS

| | | | | |
|---|---|---|---|---|
| CA | 2020561 | | 1/1991 | B65H/29/00 |
| FR | 2 365 379 | | 9/1976 | B07C/3/02 |
| JP | 01181672 A | * | 7/1989 | B65H/31/14 |

* cited by examiner

*Primary Examiner*—Eileen D. Lillis
*Assistant Examiner*—Michael Lowe
(74) *Attorney, Agent, or Firm*—Philip G. Meyers

(57) ABSTRACT

The present invention relates to a piling rack for flat parcels which is open on one side for withdrawing piled parcels. The rack has a bottom (4) as well as an impact wall (7) inclined outwardly and turning inwardly relative to the cutting edge, wherein a side wall (5) is provided for orienting the piling bottom as well as the piling direction. The parcels are inserted through an adequate opening (1) towards the bottom. The piling bottom (4) is inclined relative to the parcel orientation upon insertion into the piling rack and relative to the impact wall (7) and the side wall (5). The piling rack comprises a lid (8) which is mounted and shaped so that its inner outline extends at least from a curved portion towards the piling bottom (4) below the upper limit of the parcel trajectory. The curve is designed so that when the piling rack is empty, the parcels fall onto the impact wall (7) in a lower region adjacent to the edge directed towards the piling bottom (4), at an angle of between 70 and 90° relative to the upper surface of the parcels and so as to be parallel to said edge. After this curved area, the lid of the rack is curved from the piling bottom (4) so as to be brought into contact with the impact wall (7) within an interval relative to the piling bottom (4) which is smaller than the parcel with the smallest dimensions towards which it is oriented.

12 Claims, 1 Drawing Sheet

PILING RACK FOR FLAT PARCELS

Figure 1:
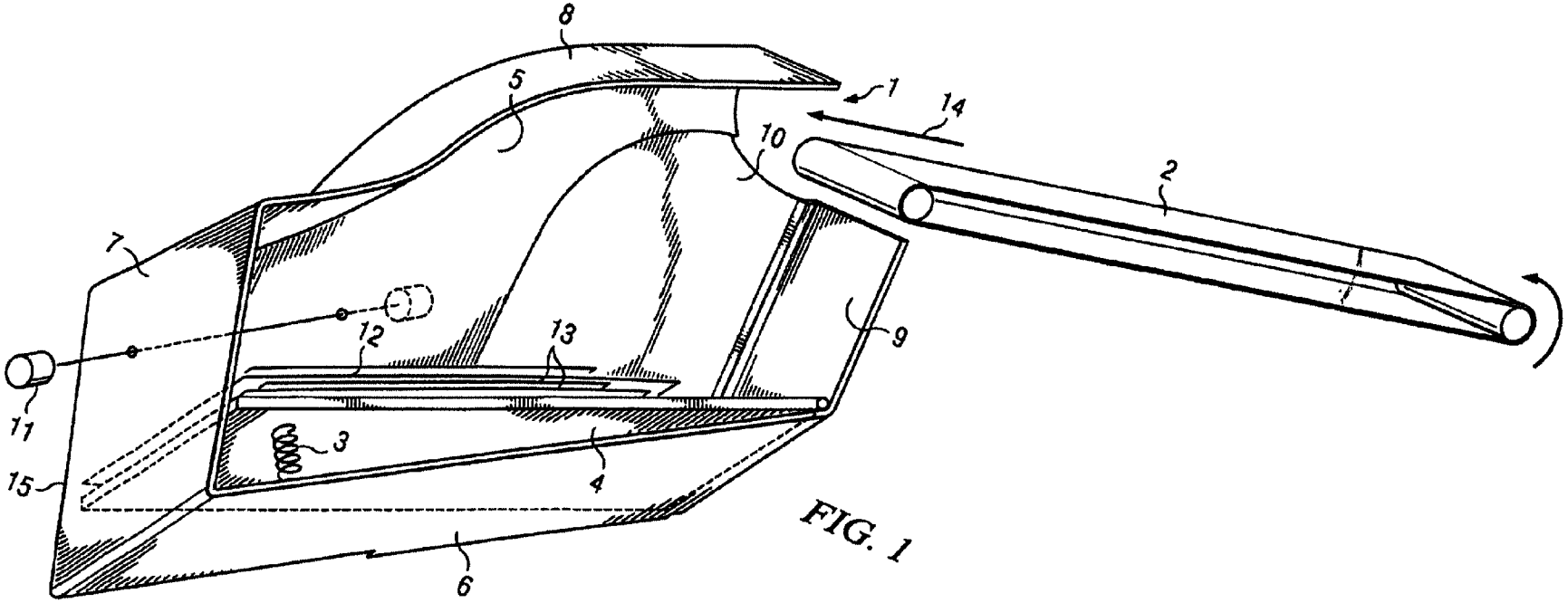

The present invention pertains to a piling bin for flat mail pieces. Piling bins of this type are frequently found in mail sorting plants. In said system, a suitable transport system uses deflectors to supply piling bins with mail pieces, such as letters and large letters, which are stacked on these bins.

Mail pieces incapable of being processed by machine are recognized by a measuring section connected in series and removed. A system of this type should be able to process the widest possible spectrum of different mail pieces, where there is the problem that variation in mail piece parameters such as size, weight and surface condition may adversely affect the piling quality and the interruption-free and time-independent ability of a piling binto receive mail pieces.

A corresponding piling bin already has become known from EP 0407795 B1. This piling bin is suitable only for a limited spectrum of goods including light and flat mail pieces, such as normal letters or postcards, which may be inserted into a piling bin at high speed. In this connection, a pivotable guide fork arranged at the entrance guides mail pieces onto the piling bottom or onto stacked mail pieces, wherein the guide fork rests on the stack of mail pieces and is pivoted as a function of the degree of fill.

The piling bottom is pivotable at the edge shared with the impact wall which is inclined forward in the piling direction. The guide fork is curved on its support such that across the pivoting range, the pressure point is at a nearly constant minimum distance from the impact wall. In order to guarantee that stacked mail pieces will be oriented to the side wall, the impact wall, in addition, turns inward toward the side wall relative to the cutting edge.

In order to prevent a mail piece to be stacked from striking the back edge of a preceding mail piece at high speed and causing stacking error, a mail piece to be stacked must not contact the preceding mail piece by less than a minimum angle. In order to guarantee this even as the height of the pile grows (the guide fork approaches a horizontal position), the piling bottom pivots downward in the direction of a horizontal position as a function of the degree of fill.

If mail pieces having vastly different compositions with respect to size, thickness and weight are stacked in bins at a substantially lower transport speed than in the aforementioned solution, then the piling bin described is not suitable, since, for example, the guide fork would slow down mail pieces by differing amounts. The result would be unsatisfactory stacking quality.

Therefore, the underlying problem of the invention indicated in the features specified herein is to create a piling bin for flat mail pieces that are fed at a low speed and that have different sizes and thicknesses, which is configured in a way that achieves a secure, rapid and aligned transport of each mail piece to the front edge of the pile through minimized loss of energy due to impact, wherein it is necessary to prevent small mail pieces from standing up in the piling bin.

The advantage of the invention exists in the achievement of an optimal piling quality of flat mail pieces within a large spectrum of sizes and thicknesses at low transport speed with limited mechanical cost. Advantageous configurations of the invention are described in the subordinate claims. The invention is explained in greater detail with the aid of the figures in the following.

Shown is:

FIG. 1, a perspective schematic representation of a piling bin open on one side.

DETAILED DESCRIPTION OF THE INVENTION

As may be deduced from FIG. 1, mail pieces are transported on a conveyor belt (2) which is pivoted toward the opening (1). In a piling bin open to one side, a movable piling floor (4) held by means of a spring (3) as a control element is inclined, in an empty state, downward and to the right toward the side wall (5) relative to the direction of insertion indicated by arrow 14 and direction of orientation of the mail pieces 13, that is, toward the back right corner in the transport direction. The spring (3) is supported against a lower plate (6) connected to the other walls of the piling bin in a fixed manner. An impact wall (7) which is struck by the inserted parcels or mail pieces 13 is inclined beyond the perpendicular to the lower plate (6). In addition, it turns inward with the side wall (5) relative to edge 15 of sidewall 5. In addition, the piling bin has a top wall (8) in addition to a back wall (9) opposite the impact wall (7). The top wall delimits the opening (1) from above such that the thickest mail piece may enter the piling bin unimpaired and the first part of the top wall extends in a straight line. As it extends further in the direction of the impact wall (7), the top wall (8) curves downward such that its inner outline extends below the upper limit of the mail piece trajectory, guiding mail pieces such that in an empty piling bin they contact the lower region of the impact wall (7) adjacent to the edge directed towards the piling floor (4) parallel to said edge at an angle of 70°–90° to the upper surface of the mail pieces. If there already are mail pieces in the piling bin, then after a certain mail piece height has been reached, mail pieces 13 to be stacked first contact the uppermost mail piece and then slide toward the impact wall (7) rather than striking the impact wall (7) directly. The forced inclination of mail pieces 13 due to the top wall (8) contributes to stabilizing the trajectory and supports the escape of air toward the open side. A piling bin executed according to the invention guarantees that the broadest variety of mail pieces 13 may be stacked securely and in alignment at an insertion speed which is not too high without the danger of mail pieces 13 falling out. After this curved region, the top wall (8) curves away from the piling floor (4) so as to meet the impact wall (7) parallel to the edge between piling floor (4) and impact wall (7) within an interval from an empty piling floor (4) which is smaller than the length of the shortest mail piece. This prevents a short mail piece from standing up which could then signal a full bin. According to the size of the stack 12 of mail pieces, the piling floor (4) held by a spring (3) pivots downward such that the interval from the uppermost mail piece to the top wall (8) remains nearly constant and is less than the shortest mail piece. The side wall (5) inclines away from the upper boundary so that the side wall does not impair the downward movement of the mail pieces. In order for mail pieces to be stacked quickly, the cushion of air which forms as mail pieces fall must be removed as quickly as possible. For this reason the side wall (5) has, adjacent to the opening, a cutout (10) through which air can escape rapidly.

In order to prevent a piling bin from overflowing, a photoelectric barrier (11) is present to monitor the filling state. This is arranged such that it detects the front inside corner of the uppermost mail piece piled at the stack height to be detected. This special arrangement prevents errors from mail pieces overlapping in the region of the opening.

In order to facilitate manual emptying of the piling bin, a piling floor also may be provided with a recessed grip so that the operator may access a pile of mail pieces without difficulty.

What is claimed is:

1. Piling rack for flat parcels with: a pivotable piling bottom which lowers as the height of the stack increases and which is inclined in a downward direction relative to the orientation of inserted parcels, an impact wall inclined outwardly relative to the orientation of the piling bottom and the direction of insertion and turning inwardly with a side wall relative to the edge of the sidewall, a back wall opposite the impact wall, having an opening which is located at the upper end of the back wall, which is aligned to the orientation of inserted parcels, and into which parcels are inserted in a downward direction, characterized in that the piling bottom is inclined toward the side wall and pivots about its edge facing the back wall, that opposite the piling bottom, a lid is provided which is curved in a downward direction toward the piling bottom and subsequently curves away from the piling bottom, wherein the inner contour of the lid, at least from the portion curved towards the piling bottom, extends below the trajectory of inserted parcels and wherein the portion of the lid curving away from the piling bottom contacts the impact wall in alignment with the piling bottom such that, for an empty piling rack, the distance at the impact wall between the portion curving away from the piling bottom and the piling bottom likewise is smaller than the shortest parcel, wherein, for a full stack, the distance at the impact wall between the portion curving away from the piling bottom and the upper most parcel likewise is smaller than the shortest parcel.

2. Piling rack described under claim 1, characterized in that the lid has, prior to the portion curved toward the piling bottom, a straight portion aligned with the direction of insertion.

3. Piling rack described under claim 1, characterized in that a control element holds the piling bottom in its respective pivoted setting.

4. Piling rack described under claim 1, characterized in that the control element holding the piling bottom is a spring.

5. Piling rack described under claim 1, characterized in that the side wall is inclined outwardly in the direction of the piling bottom.

6. Piling rack described under claim 1, characterized in that the side wall has a cutout adjacent to the opening.

7. Piling rack described under claim 1, characterized in that a photoelectric barrier is provided in order to monitor the filling state, and the photoelectric barrier detects the front inside corner of the uppermost parcel at the stack height to be detected.

8. A piling bin for flat mail pieces, comprising:

a bin defining a compartment for creating a substantially horizontal stack of flat mail pieces, the bin having a side wall, a bottom wall, a pair of end walls, an open side for removal of stacked mail pieces, a top wall, and an entry slot in one end thereof between one end wall and the top wall configured to admit mail pieces into the compartment one at a time;

wherein the top wall has an internal contour which guides a flat mail piece from the entry slot downwardly into a corner of the bin defined between a side wall and an end wall remote from the entry opening, which end wall acts as an impact wall for mail pieces entering through the entry slot at the top of the stack; and a piling floor pivotably mounted adjacent the end wall proximate the entry opening, the piling floor being inclined toward the sidewall and disposed inside the bin positioned to support a stack of mail pieces in the compartment from beneath.

9. The piling bin of claim 8, wherein the piling floor is inclined towards a corner at which the side wall meets the end impact wall.

10. The piling bin of claim 8, wherein the piling floor is spring loaded against the bottom wall of the bin, so that the weight of the stack of mail pieces compresses the spring and moves the piling floor downwardly as the number of mail pieces in the stack increases.

11. The piling bin of claim 8, wherein the top wall has a downwardly curved guide surface that directs a first mail piece entering through the entry slot into the compartment in an empty state to contact the impact wall at an angle of 70°–90°.

12. The piling bin of claim 11, wherein the distance between the portion of the top wall adjacent the impact wall and the piling floor is less than the length of the smallest mail piece such that the smallest mail piece cannot stand on end between the top wall and piling floor near the impact wall.

* * * * *